United States Patent [19]

Fremion

[11] 4,262,837

[45] Apr. 21, 1981

[54] MULTIPLE BLANK BOTTLE CARRIER

[75] Inventor: Edwin A. Fremion, Cleveland, Tenn.

[73] Assignee: Westvaco Corporation, New York, N.Y.

[21] Appl. No.: 82,482

[22] Filed: Oct. 9, 1979

[51] Int. Cl.[3] ..... B65D 5/48

[52] U.S. Cl. ..... 229/23 R; 229/27; 229/28 BC; 229/52 B; 229/15

[58] Field of Search ..... 229/15, 23 R, 27, 28 BC, 229/52 B, 3.1

[56] References Cited

U.S. PATENT DOCUMENTS

| | | | |
|---|---|---|---|
| 1,798,612 | 3/1931 | Malcomson | 229/28 |
| 2,693,297 | 11/1954 | Bolding | 229/27 X |
| 2,747,767 | 5/1956 | Bergstein | 229/28 BC X |
| 2,823,845 | 2/1958 | Wasyluka | 229/15 |
| 2,850,223 | 9/1958 | Strauss | 229/15 |
| 3,399,819 | 9/1968 | Rennie et al. | 229/3.1 X |
| 3,452,920 | 7/1969 | Milne et al. | 229/27 |
| 3,547,339 | 12/1970 | Bruce | 229/15 |
| 3,825,170 | 7/1974 | Aust et al. | 229/52 B X |
| 3,827,625 | 8/1974 | Miller | 229/48 SB |
| 4,039,117 | 8/1977 | Sieffert | 229/15 |
| 4,091,983 | 5/1978 | Booth et al. | 229/15 |

FOREIGN PATENT DOCUMENTS

| | | | |
|---|---|---|---|
| 2320190 | 11/1973 | Fed. Rep. of Germany | 229/298 BC |

*Primary Examiner*—Davis T. Moorhead

[57] ABSTRACT

The bottle carrier of the present invention is constructed from two half slotted containers that have their manufacturers joint located substantially midway along a side wall and which are connected together along that side wall to provide an integral divider that separates the carrier into two equally sized compartments. The two half slotted containers also include partial hand hole cut outs in each end wall which come together when the containers are connected to form a pair of complete hand hole openings.

5 Claims, 4 Drawing Figures

MULTIPLE BLANK BOTTLE CARRIER

BACKGROUND OF INVENTION

The present invention relates to compartmented paperboard carriers and more particularly to a bottle carrier or the like prepared from two identical blanks of cut and scored corrugated paperboard.

There are a great number of bottle carriers presently on the market for use with one way bottles. However, in most cases, these bottle carriers are prepared from lightweight paperboard since the anticipated use is for conventionally sized bottles. On the other hand, there is a distinct need for heavy duty carriers that can be used both for returnable bottles and/or for oversized one way bottles. Moreover, there is a need for such a container that is inexpensive to manufacture and easy to set up for use.

In this regard, the patent literature discloses several different container designs that more-or-less satisfy the intended purpose. For instance, U.S. Pat. No. 2,850,223 discloses a heavy duty carrier that is prepared from a single blank of paperboard. Similarly, U.S. Pat. No. 3,547,339 shows such a container that is also constructed from a one piece blank of corrugated paperboard. However, in each case, the carriers are prepared from complicated blanks that use an extraordinary amount of paperboard material and which must be prepared on a die press or the like which generates a lot of waste material. In like manner, the patent literature also discloses heavy duty bottle carriers prepared from multiple blanks of paperboard. For instance, U.S. Pat. No. 1,798,612 discloses a bottle carrier prepared either from two separate blanks (FIG. 6) or from two blanks that are secured together (FIG. 8). Meanwhile, U.S. Pat. No. 2,823,845 discloses a bottle carrier prepared from several blanks that are stapled together. However, these carriers are obviously expensive and difficult to fabricate.

In contrast to the above, the bottle carrier of the present invention is prepared from two identical blanks of corrugated paperboard which are partially formed by the manufacturer and then shipped in collapsed condition to the user. At the point of use, the bottom flaps of the blanks are sealed together and the two container halves are adhered together to produce a single bottle carrier with an integral divider. Furthermore, the two blanks used to prepare the bottle carrier disclosed herein are each prepared on high speed equipment with a minimum of waste. Thus, the bottle carrier prepared in accordance with the present invention is inexpensive to manufacture and is easily formed and glued on readily available equipment.

SUMMARY OF THE INVENTION

It is an object of the present invention to provide a low cost, easily manufactured bottle carrier particularly for use in carrying six or more large bottles of soda, beer or other liquid materials. In this regard, it is of paramount importance that the carrier of the present invention is rugged, strong and that it is easily manufactured and formed on readily available equipment for large volume users.

To satisfy these requirements, the bottle carrier of the present invention is preferably manufactured from corrugated paperboard or corrugated paperboard that has been treated to be moisture and vermin resistant. Moreover, the design of the bottle carrier of the present invention is such that it can be run on a printer-slotter, a machine that is used extensively in the corrugated industry for slotting a container blank to form closure flaps and for scoring the blank in the direction opposite to those scores normally made on a corrugator. In the present case, the blanks are also provided with hand hole cut outs at the printer slotter using a special attachment. This provision eliminates the need for a separate die cutting step which is normally accomplished on a die press. Thus, as manufactured, the bottle carrier of the present invention is comprised of two half slotted containers which are connected together to provide a structure having two equally sized compartments.

It is a specific object of the present invention to provide a compartmented bottle carrier formed from two identical half slotted containers, each including four side walls and bottom closure flaps, wherein the carrier is formed when two adjacent side walls of the separate containers are adhered together.

A further object is to provide two connected containers of the type described wherein the end walls of each include aligned hand hole cut outs which when joined together, form a complete hand hole opening.

An additional object of the present invention lies in the provision whereby the two half slotted containers may be joined together with a break apart adhesive that allows marketing of two halves of the complete carrier.

The half slotted containers used to prepare the bottle carrier of the present invention are of the style generally referred to in the industry as regular slotted containers, except that, because the containers used herein do not have top closure flaps, they are properly called half slotted containers. However, as in the case of a regular slotted container, the bottom closure flaps of the containers are all of the same length, the outer closure flaps meet one another at the center of the container, and they are adhered to the inner closure flaps at each end of the container. On the other hand, the half slotted containers of the present invention differ from a regular slotted container in the location of their manufacturers joints. In a regular slotted container, the manufacturers joint is conventionally located at one corner where it is taped, stapled or glued closed. However, in the present case, the manufacturers joint has been moved to a point located substantially midway along one of the side walls where there is an overlap which is glued together. The relocation of the manufacturers joint to the side wall allows the blanks to be run on high speed production equipment and permits identical blanks to be rotated and glued together to form the bottle carrier without excessive paper build up.

Accordingly, these and other objects and advantages of the invention will become apparent from a review of the following drawing and detailed description.

DETAILED DESCRIPTION

Figure 1:
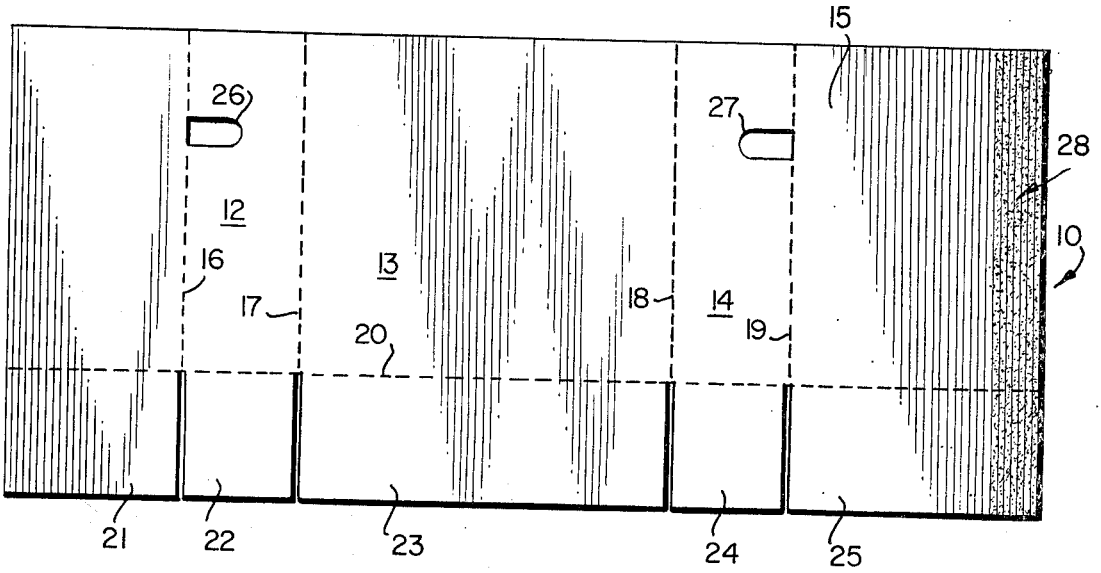
FIG. 1 is a plan view of one of the production blanks used to prepare the carrier of the present invention.
Figure 2:
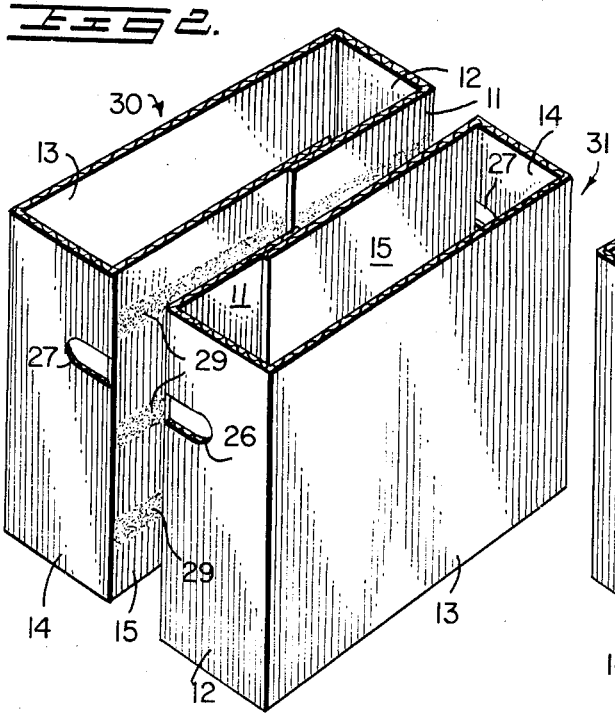
FIG. 2 is an expanded view in perspective showing the two containers of the present invention fully formed and prior to being adhered together.

Referring first to FIG. 1 of the drawing, there is illustrated one of the half slotted container blanks 10 that are used to form the container halves shown in FIG. 2. The blank 10 is preferably constructed from corrugated paperboard and includes a series of wall panels 11, 12, 13, 14 and 15 separated from one another by scored fold lines 16, 17, 18 and 19, and a plurality of bottom closure flaps 21, 22, 23, 24 and 25 separated from the wall panels by a scored fold line 20. In addition, each blank 10 also includes a pair of hand hole cut outs 26,27 applied to the wall panels 12,14.

When the wall panels are folded as shown in FIG. 2, they provide a pair of end walls 12,14 and a pair of side walls formed by panel 13 and the two remaining panels 11,15. For this purpose, the wall panel 15 is made slightly longer than wall panel 11, which generally has a length equal to about one-half the width of the container, to provide an overlap where adhesive 28 is applied. Thus, each half slotted container 30 and 31 has its manufacturers joint located midway of a side wall rather than at a corner in the conventional fashion. Moreover, when the containers are formed, in each case the longer wall 15 is always arranged on the inside of the other wall 11. This arrangement permits the two exterior walls 11 of adjacent containers 30,31 to be butted end-to-end when the two containers are adhered together. Accordingly, as shown more clearly in FIGS. 3 and 4, such arrangement allows the two containers to be adhered together without excessive paper build up in the bonding area.

Figure 3:
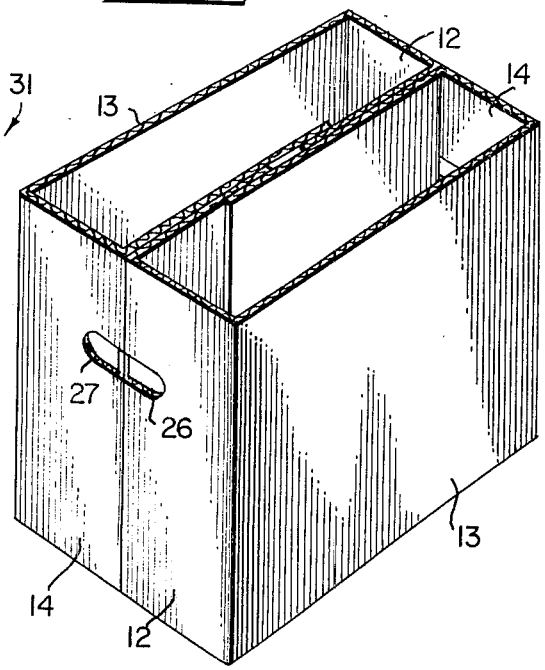
FIG. 3 is a perspective view of the completed bottle carrier.

FIG. 2 shows the preferred method for bonding the two containers 30,31 together wherein the side wall 11,15 of container 30 is applied with lines of adhesive 29 before the two containers 30,31 are brought together. When the two containers 30,31 are bonded, the two half side walls 11 form one continuous wall. Meanwhile, as shown in FIG. 3, the partial hand hole cut outs 26,27 at each end come together to produce two complete hand hole openings. Where desired, the adhesive at 29 can be of the releasible type so that the containers may be broken apart if necessary. Moreover, in order to achieve even more strength in the bottom closure, the bottom closure flaps 21,22,23,24 and 25 could, if desired, be formed of the partial or full overlap style. However, in such a case, a more expensive and less desirable construction would be produced which requires more material.

Figure 4:
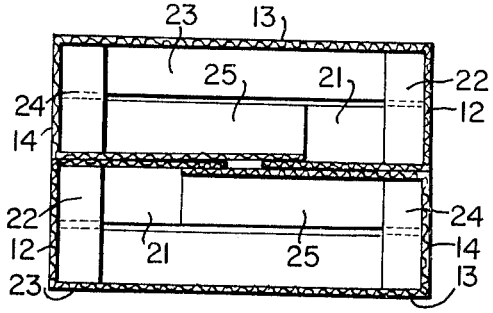
FIG. 4 is a top view of the bottle carrier of FIG. 3 showing the glued connection.

FIG. 4 shows a top view of the preferred half slotted style for the containers 30,31. Note that the bottom closure flaps 22 and 24 are folded inwardly first and the remaining flaps 23 and 21,25 are folded over and adhered to the flaps 22 and 24 to seal the bottom. Thus, as prescribed for a typical half slotted container, the bottom closure flaps 21,25 of each container overlap one another and together meet flap 23 in the center of the container while the remaining flaps 22 and 24 serve as glued supports.

It will thus be seen that the present invention comprises a useful and economical bottle carrier for transporting large returnable and/or nonreturnable bottles of soda, beer, chemicals or other similar products. The carrier is prepared from a pair of rectangular coordinated blanks of corrugated paperboard which are simple and economical to manufacture, and which are shipped to the user in partially finished condition where they are set up, finally assembled and filled. When set up as disclosed herein, the carrier so formed is of rigid construction with an integral divider for conveniently carrying six bottles as described above. Accordingly, while the foregoing detailed description has been given for clarity in understanding the invention, no limitations are intended. Therefore, the invention should be construed as broadly as permissable in view of the prior art, since various changes may be made therein within the scope of the appended claims.

I claim:

1. A compartmented bottle carrier constructed from two identical blanks of corrugated paperboard which separately form individual containers that are adhered together, each of said containers comprising a pair of opposed side walls and a pair of opposed end walls connected to one another along parallel fold lines, and a plurality of bottom closure flaps foldably connected along a common score line to the bottom end of said side and end walls, the improvement wherein the individual containers each have a manufacturers joint formed from two overlapping panels located substantially midway of one of their side walls, the first of said overlapping panels having a length substantially equal to one half of the width of said side wall and the second of said panels having a length that is greater than one half the width of said side wall, said first overlapping panels being arranged to lie exteriorly of said second overlapping panels in each case so that when the two individual containers are adhered together along the side walls containing their manufacturers joints, the ends of the first overlapping panels of the two individual containers butt one another to form one continuous wall.

2. The bottle carrier of claim 1 wherein each of the opposed end walls of each individual container contains a partial hand hole cut out whereby when the two containers are adhered together, the partial cut outs of the two adjacent containers produce complete hand hole openings at each end of the carrier.

3. The bottle carrier of claim 2 wherein the two individual containers are adhered together with a break apart adhesive.

4. The bottle carrier of claim 3 wherein the adhered common side walls of the two individual containers provides an integral divider which separates the carrier into two equally sized compartments.

5. The bottle carrier of claim 4 wherein the corrugated paperboard blanks are treated so as to be moisture resistant.

* * * * *